United States Patent [19]

Sauter

[11] 4,183,204

[45] Jan. 15, 1980

[54] MEANS FOR SUPPORTING CLOCKWORK ELEMENTS OF CLOCKS

[76] Inventor: Roland Sauter, Eckener Strasse 34, D-7220 VS-Schwenningen, Fed. Rep. of Germany

[21] Appl. No.: 816,972

[22] Filed: Jul. 19, 1977

[30] Foreign Application Priority Data

Aug. 5, 1976 [DE] Fed. Rep. of Germany ..... 7624675

[51] Int. Cl.[2] ..... G04B 19/00

[52] U.S. Cl. ..... 58/126 R; 174/65 G; 174/153 G; 58/140 R

[58] Field of Search ..... 174/65 G, 153 G; 16/2; 248/56; 58/126 R, 126 A, 126 C, 140 R

[56] References Cited

U.S. PATENT DOCUMENTS

| | | | |
|---|---|---|---|
| 3,004,238 | 10/1961 | Damon | 174/153 G |
| 3,164,054 | 1/1965 | Biesecker | 174/153 G |
| 3,768,115 | 10/1973 | Hoffman | 174/153 G |
| 3,896,682 | 7/1975 | Kreidler | 58/140 R |
| 3,991,446 | 11/1976 | Mooney | 174/153 G |

*Primary Examiner*—Gene Z. Rubinson
*Assistant Examiner*—Leonard W. Pojunas, Jr.
*Attorney, Agent, or Firm*—Pollock, Vande Sande & Priddy

[57] ABSTRACT

A hollow generally cylindrical member is provided as a central support means for the clockwork of watches or clocks. The member has an outwardly extending annular flange portion against which may be abutted such clockwork elements as a dial carrier and a mechanism housing in superposed relation. The cylindrical member comprises, at the end thereof opposite the flange, a plurality of resiliently supported latch portions which are formed by providing U-shaped recesses extending axially inwardly from said other end of the bushing, with the result that each latch portion can be flexed radially inwardly since the bushing is preferably formed of a generally elastic material. The dial carrier and mechanism housing may be pressed axially on the bushing at its other end, and since each latch portion is provided with a chamfered outer surface, the axially exerted force causes each of the latch portions to be flexed inwardly to permit the dial carrier and mechanism housing to be placed over the latch portions which then spring back to hold both the dial carrier and mechanism housing against the outer flange.

7 Claims, 5 Drawing Figures

MEANS FOR SUPPORTING CLOCKWORK ELEMENTS OF CLOCKS

BACKGROUND OF THE INVENTION

The present invention relates to a central supporting member used to support a clockwork mechanism of a clock. The supporting element is generally in the shape of a hollow cylinder having an annular flange which extends outwardly from one end of the bushing and acts as a supporting surface for a watch dial carrier and a mechanism housing both of which are supported in a juxtaposed position thereon.

Although support elements for the works of a clock are known in the prior art, the prior art elements generally comprise a housing having external threads to permit threading engagement of the housing with internal threads formed on a cylindrical portion of the mechanism housing. As a result of the threaded connection, the dial carrier and the mechanism housing can be screwed onto the supporting member so as to abut an outwardly extending flange on the member. The shaft for the hands on the clock then extend through the interior cylindrical bore of the cylindrical member.

The prior art supporting elements for the works of a clock have the disadvantage that production costs of the cylindrical bushing are relatively high because of the need to provide threads thereon. Also, assembly time is high because of the need to conduct the threading operation whereby the mechanism housing for the clockworks is threaded onto the bushing.

SUMMARY OF THE INVENTION

It is an object of this invention to provide a support element for the works of a clock which can be easily manufactured at low cost, and which can quickly and conveniently be assembled to the mechanism housing. This result is accomplished by providing a cylindrical bushing-like member having a plurality of latch-like portions which together form a generally annular configuration and which act to maintain the mechanism carrier urged against an outwardly extending annular flange on the member. The bushing is so constructed that the latch portions are elastically deformable so that they can be urged centrally inwardly and thereby permit the mechanism carrier to be forced over the latches in a generally snap-fit fashion.

The clockwork support element of the present invention provides the advantage that it can readily be made at low cost and results also in lower assembly cost since a simple press-on operation is all that is required to assemble the clockwork mechanism onto the support element.

In a preferred embodiment, three latch portions are provided at equal angular intervals about the member. Preferably also the end of each latch portion is chamfered so as to make it more readily possible for each of the latch portions to be flexed inwardly when the clockwork elements are axially pressed upon the member. Also, in the preferred embodiment, the required elastic deformability of the member in the region of the latches is provided by forming a plurality of axially extending recesses in its cylindrical main body portion. Desirably, three such recesses are provided which are spaced at equal angular intervals and whose longitudinal depth along the axis of the member extends for at least one-half the member's axial length.

The outer annular flange of the member may be provided by axially extending protuberances to facilitate engagement with the dial carrier on the clock. Preferably three such axially extending segments are provided at equal angular intervals. This makes it possible to provide an axial spring suspension at the points of contact between the member and the dial carrier, such spring suspension being provided by the axially protruding protuberances as well as the latches, to thereby compensate for dimensional tolerances.

In order to save material and to improve the spring action in the axial direction, it is preferable to join the annular flange to the member by means of a plurality of radial extending web portions. These web portions may be spaced so as to generally lie opposite each of the axially extending recesses previously mentioned. The latch portions of the member are preferably arranged so that each lies between a successive pair of the web portions.

When the dial carrier and the clockwork housing are assembled onto the member, it is readily possible to provide resistance to rotation between these elements. This can be accomplished by providing an axially extending pin on one of these elements which engages in a mating recess on the other.

Reduced cost of manufacture and improved resilience to achieve the desired effect can be accomplished by molding the bushing element from a plastic material.

BRIEF DESCRIPTION OF THE DRAWINGS

In describing the invention, reference will be made to the accompanying drawings in which.

DETAILED DESCRIPTION OF THE PREFERRED EMBODIMENT

Figure 1:
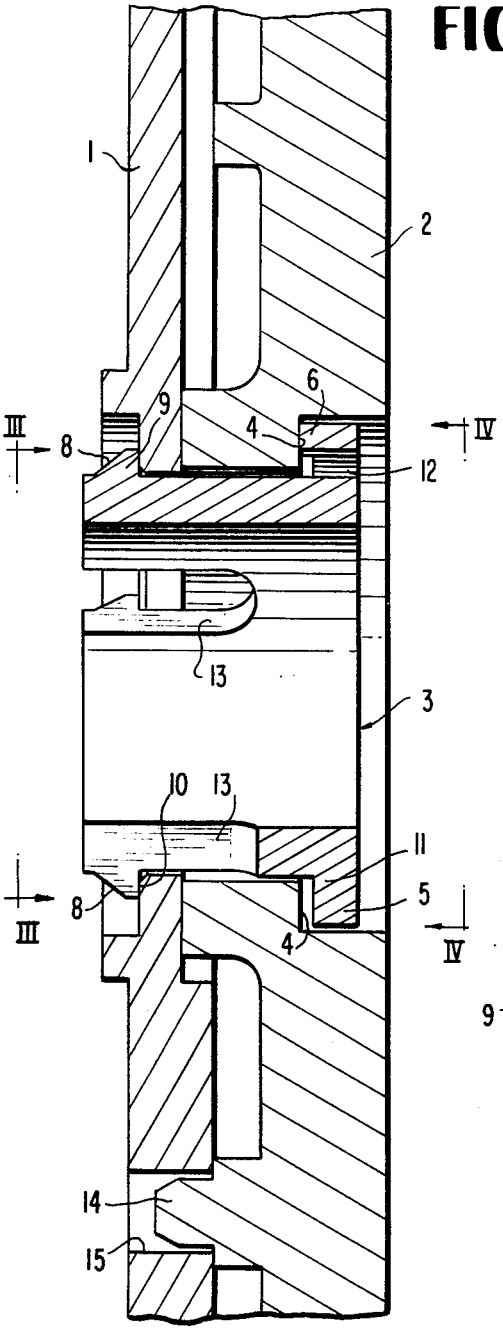
FIG. 1 comprises a cross-sectional view of a central support element for a clockwork.

The central clockwork support means shown in the drawing includes a hollow cylindrical member 3 which is provided at one end thereof with an annular outwardly extending flange portion 5. Extending outwardly from the opposite end of the member are a plurality of latch-like portions 9 which are disposed at equal angular intervals with respect to each other. Each of these latch-like portions is provided with a chamfered surface 8, the angle of which relative to the axis of the bushing amounts to about 35°. Each latch portion 9 is also provided with a radially extending surface 10 which faces the flange 5 at the opposite end of the bushing.

The annular flange portion 5 is preferably connected to the main part of the member 3 by a plurality of web portions 11 which also are spaced at equal angular intervals about the bushing. Between these web portions 11, annular shaped recesses 12 are formed.

A plurality of axially-extending protuberances 6 are formed on the surface of flange 5 which extend toward the opposite end of member 3. Three of these are also provided and are preferably located midway between each successive pair of web portions 11. The spacing between the upper surface of each protuberance 6 as shown in FIG. 2 and the radially extending surface 10 (see FIG. 1) is selected to be slightly less than the combined thickness of the dial carrier 2 and mechanism housing 1 when these two are placed in juxtaposition upon member 3. As a result, when the elements 1 and 2 are snapped onto the member 3, there is a tendency for the annular flange 5 to be slightly deformed in the axial direction as a result of the forces which are exerted upon the protuberances 6 by the dial carrier 2 resting thereupon. As a result of this arrangement, any tolerances are eliminated, thereby ensuring that there is a snug fit of the elements 1 and 2 upon member 3.

Figure 2:
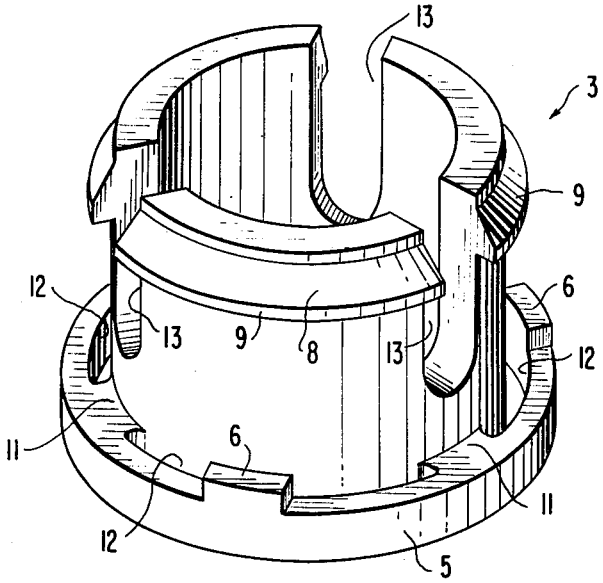
FIG. 2 is a perspective view of the bushing shown in cross-sectional view in FIG. 1.
Figure 3:
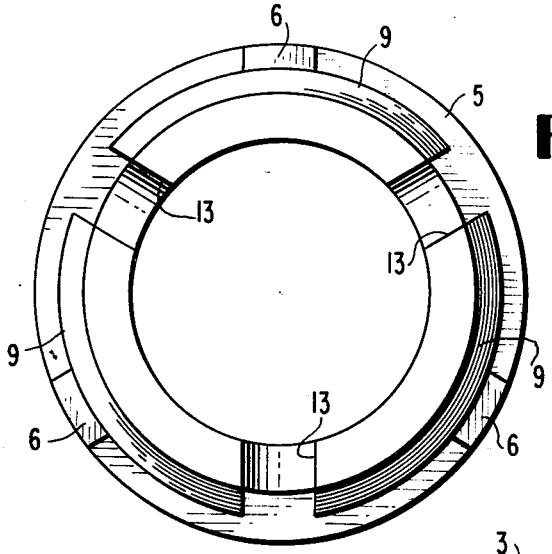
FIG. 3 is a view of the bushing of FIG. 1 taken in the direction represented by the line III—III.
Figure 4:
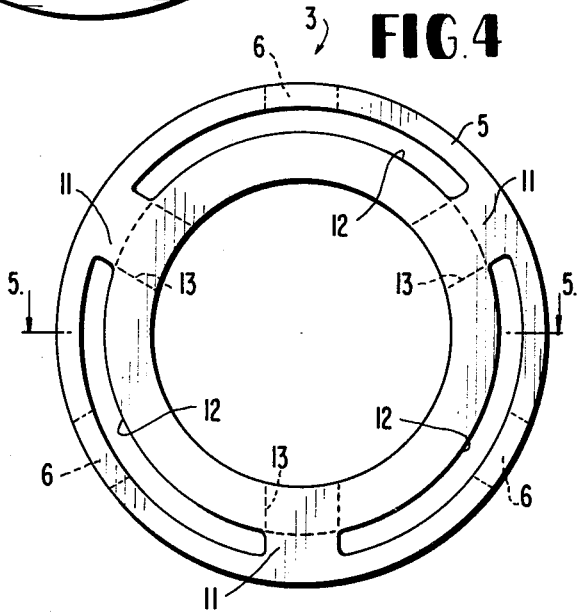
FIG. 4 is a view taken in the direction represented by the line IV—IV of FIG. 1.
Figure 5:
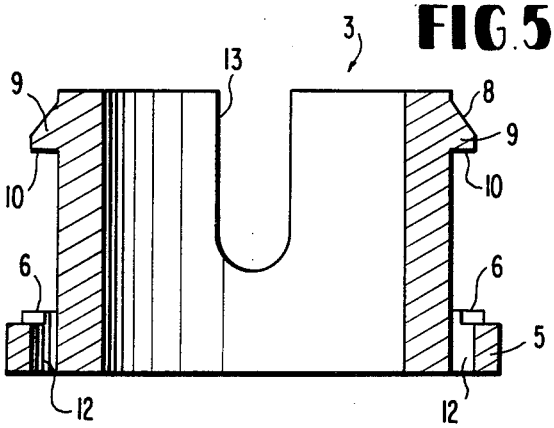
FIG. 5 is a cross-sectional view of the bushing shown in FIGS. 1-4.

As shown in FIG. 1, the dial carrier 2 may be provided with an outwardly extending pin 14 which engages in a mating recess 15 in the mechanism carrier 1 which then ensures that there can be no relative rotation between the elements 1 and 2 when they are placed upon member 3.

As can be seen in FIG. 1 also, the upper surfaces of the protuberances 6 as shown in FIG. 2 abut an inner shoulder 4 formed in the dial carrier 2 thereby ensuring that flange 5 properly fits into a recess provided in the element 2.

Three U-shaped recesses 13 are shown as extending longitudinally from one end of the member 3 toward the lower end as shown in FIG. 2. These axial recesses are also spaced at equal angular intervals about the bushing and preferably extend to a depth which is more than one-half of the axial length of the bushing. Referring to FIG. 2, it can be seen that each web portion 11 lies generally opposite a corresponding recess 13, and also it is shown that each latch portion 9 is so located as to be generally axially aligned with a respective one of the recesses 12.

To assemble the mechanism housing 1 and dial carrier 2 onto the bushing, each of the elements 1 and 2 is sequentially pressed against the chamfered surfaces 8 on the flange portions 9. The axial pressure exerted on the flange portions 9 causes them to each be pressed inwardly toward the central axis of the bushing so that effectively the member's exterior diameter is reduced at that end. When each element has thus been pressed over the latch-end portion of the member 3, each of the latch portions immediately springs back to the normal position shown in FIG. 2 so that each element is then retained under the radially extending surface 10. When both elements 1 and 2 are then finally assembled onto the member 3, the radial extending surfaces 10 urge both of the elements 1 and 2 downwardly so as to press against the protuberances 6 as previously mentioned.

What I claim is:

1. Apparatus comprising a central support means for retaining clockwork mechanism elements such as a dial carrier and a mechanism housing, said central support means comprising a generally cylindrical member having a diameter over its main body portion slightly less than that of the through apertures in said elements and having adjacent one end thereof an outwardly extending radial flange whose surface facing the opposite end of said member forms a supporting ledge for said elements when fitted with their respective through apertures surrounding said main body portion, said cylindrical member having at its said opposite end a plurality of resiliently supported latch means for insertion into said through apertures of said elements during assembly of said elements into said member, said member defining a plurality of axially extending recesses extending from said opposite end of said member to form at least in part said latch means, said latch means each having at least a portion thereof normally extending beyond the diameter of the main body portion of said cylindrical member and each being resiliently movable toward the central axis of said member to permit the placement of each said element over said plurality of latch means and onto said member in abutment with said ledge, each said latch means being restored by its resilient support to its normal position once said elements have been assembled onto said member, each said latch means having a surface thereon which faces said one end of said member to thereby prevent inadvertent removal of said elements from said member once assembled thereon, said radial flange being joined to said main body portion by a plurality of angularly spaced ribs each disposed generally opposite a corresponding one of said recesses, said radial flange supporting thereon a plurality of upstanding protuberances whose spacing from said surfaces on said latch means is slightly less than the combined thicknesses of said elements supported on said central support means, each said protuberance being supported substantially midway between a pair of said ribs.

2. The apparatus of claim 1 in which three said latch means are disposed at equal angular intervals about said member.

3. The apparatus of claim 1 in which each said latch means has its end portion closest to said opposite end of said member chamfered at an angle to the axis of said member to produce inward movement of said latch means when each said element is forced axially against said latch means.

4. The apparatus of claim 1 in which three said recesses are formed in said member to define thereby three said latch means.

5. The apparatus of claim 1 in which each said rib lies generally opposite one of said recesses.

6. The apparatus of claim 1 in which one of said elements supports a projecting pin which fits into a mating recess on the other said element.

7. The apparatus of claim 1 in which said member is formed of a plastic material.

* * * * *